US007464930B2

(12) United States Patent
Masuda et al.

(10) Patent No.: US 7,464,930 B2
(45) Date of Patent: Dec. 16, 2008

(54) SHEET STACKING DEVICE AND IMAGE FORMING APPARATUS INCLUDING THE SAME

(75) Inventors: Junya Masuda, Nara (JP); Yoshinori Shiraishi, Nara (JP); Yasuhiro Takai, Nara (JP); Toyokazu Mori, Kyoto (JP); Kohichi Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/627,395

(22) Filed: Jan. 26, 2007

(65) Prior Publication Data

US 2008/0012209 A1 Jan. 17, 2008

(30) Foreign Application Priority Data

Feb. 13, 2006 (JP) ..... 2006-035674

(51) Int. Cl.
*B65H 31/20* (2006.01)

(52) U.S. Cl. ..... 271/224; 271/223

(58) Field of Classification Search ..... 271/223, 271/224, 207, 3.02
See application file for complete search history.

(56) References Cited

U.S. PATENT DOCUMENTS 4,664,368 A * 5/1987 Bouwens et al. ..... 271/209
5,927,711 A * 7/1999 Tsai ..... 271/221
6,073,925 A * 6/2000 Sato ..... 271/171
6,203,365 B1 * 3/2001 Wu ..... 439/540.1
6,354,588 B1 * 3/2002 Kuwahara et al. ..... 271/224

FOREIGN PATENT DOCUMENTS

| | | |
|---|---|---|
| JP | 01-220676 | 9/1989 |
| JP | 01-261163 | 10/1989 |
| JP | 07-242361 | 9/1995 |
| JP | 11-180615 | 7/1999 |
| JP | 2002-226119 | 8/2002 |

* cited by examiner

*Primary Examiner*—Kaitlin S Joerger
(74) *Attorney, Agent, or Firm*—Renner, Otto, Boisselle & Sklar, LLP

(57) ABSTRACT

A movable sheet stacking device including: a sheet receiving section which is provided with respect to a sheet exit section of an image forming apparatus and is for receiving ejected sheets being ejected from the sheet exit section in an ejecting direction and moving the sheets in a direction opposite to the ejecting direction; an end-portion restriction plate which comes into contact with a front end of the sheets moving in the opposite direction to stop the movement of the sheets; and a restriction-plate driving section which sets a position of the end-portion restriction plate according to a sheet type.

13 Claims, 9 Drawing Sheets

| SHEET SIZE | SHEET BASIS WEIGHT ($g / m^2$) | DROP POINT ON EXIT TRAY |
|---|---|---|
| A5 | 85 | □ |
| A4 | 85 | ○ |
| A3 | 85 | △ |
| POSTCARD | 128 | ☆ |
| A4 | 100 | ● |

SHEET STACKING DEVICE AND IMAGE FORMING APPARATUS INCLUDING THE SAME

CROSS-REFERENCE TO RELATED APPLICATION

This application is related to Japanese application No.2006-035674 filed on Feb. 13, 2006 whose priority is claimed under 35 USC §119, the disclosure of which is incorporated by reference in its entirety.

BACKGROUND OF THE INVENTION

1. Field of the Invention

The present invention relates to a sheet stacking device and an image forming apparatus including the same.

2. Description of the Related Art

A sheet stacking device such as an exit tray used for stacking sheets ejected from an image forming apparatus is required to have an adequate stackability, namely a stacking ability enough to stack ejected sheets tidily on the sheet stacking section, thereby eliminating a need for a user to align the sheet bundle after taking out the stacked sheets therefrom. If the sheet stacking device has an insufficient staking ability, the user is required to align the sheet bundle taken out from the sheet stacking section by hand, thereby requiring the user to perform extra operations.

On the other hand, in recent years, there has been increasingly a need for higher-speed image forming apparatuses. In order to address the need, apparatuses with higher printing speeds have been provided. For example, although apparatuses with printing speeds of 60 sheets per minute (in cases of transferring A4 sheets in the lateral direction) or more have been conventionally regarded as high-speed apparatuses, in recent years apparatuses with printing speeds of 80 sheets per minute or more have been regarded as high-speed apparatuses. Furthermore, even apparatuses with printing speeds of 100 sheets per minute or more have been developed. Such high-speed apparatuses have tendency to increase the sheet ejecting speeds in ejecting sheets from the apparatuses. The increase of the ejecting speeds increases the difficulty in ensuring adequate stackability with the sheet stacking sections.

Therefore, for example, there has been employed a method of inclining an exit tray such that the side of the exit tray farther from an exit portion is higher, for allowing the top end of ejected sheets in an ejecting direction to come into contact with the exit tray rapidly. This can apply a braking force to the sheets with the frictional force between the exit tray and the sheets and also can rapidly brake the sheets after the sheets are separated at their rear end from the exit roller to lose propulsion forces. The rear end of sheets drop due to their weights (for example, refer to Japanese Unexamined Patent Publication No. HEI 11(1999)-180615).

Further, there has been known a method of inclining an exit tray such that its side closer to an exit port is higher for aligning the front end of sheets (for example, refer to Japanese Unexamined Patent Publication No. HEI 7(1995)-242361). However, with this method, in cases where ejected sheets have more than one size, for example, in cases where there are sheets having a greater length in the ejecting direction (larger-size sheets) and sheets having a smaller length in the ejecting direction (smaller-size sheets) and also there is a significant length difference therebetween, the rear end of a previously ejected smaller-size sheet drops to a position farther than the drop position of a subsequently ejected smaller-size sheet, which may inconveniently cause the edge of the subsequent sheet to crawl under the previous sheet. This changes the order of ejected sheets, even though a user does not desire that.

As described above, high-speed image forming apparatuses have sheet transfer speeds higher than conventional sheet transfer speeds. Accordingly, it is more difficult to ensure an adequate stackability by braking sheets through the frictional force between the sheet edge and the exit tray, than in medium and lower speed apparatuses.

Furthermore, in some cases, it is difficult to ensure an adequate stackability by relying only on the sheet propulsive force caused by the exit section and the effect of the gravity, in high-speed apparatuses. There has been a need for a method of controlling the behavior of ejected sheets, according to the types of sheets such as the sizes and the weights of the sheets.

SUMMARY OF THE INVENTION

The present invention was made in view of the aforementioned circumstances and aims at providing a sheet stacking device capable of controlling the behavior of sheets ejected from an image forming apparatus according to the types of sheets such as the sizes and the weight of the sheets for stacking the sheets tidily, and an image forming apparatus including such a sheet stacking device.

According to the present invention, there is provided a movable sheet stacking device including: a sheet receiving section which is provided with respect to a sheet exit section of an image forming apparatus and is for receiving ejected sheets being ejected from the sheet exit seciton in an ejecting direction and moving the sheets in a direction opposite to the ejecting direction; an end-portion restriction plate which comes into contact with a front end of the sheets moving in the opposite direction to stop the movement of the sheets; and a restriction-plate driving section which sets a position of the end-portion restriction plate according to a sheet type.

Further, according to the present invention, there is provided an image forming apparatus including the aforementioned sheet stacking device.

Since sheet stacking device according to the present invention includes the restriction-plate driving section which sets the position of the end-portion restriction plate, according to the sheet type, it enables stacking sheets while aligning the front end of the sheets at a position corresponding to the sheet type.

In this case, the sheet exit section is for successively ejecting plural sheets from the image forming apparatus. In cases where a post-processing device is mounted to the image forming apparatus, the term "image forming apparatus" refers to the apparatus including the post-processing device.

Also, the sheet receiving section can be obliquely placed such that its side closer to the sheet exit section is lower, for causing sheets received by the sheet receiving section to move in the direction opposite to the sheet ejecting direction. However, the means for moving sheets in the opposite direction is not limited thereto. For example, it is possible to provide a collision plate which comes into contact with the rear end of sheets traveling in the ejecting direction for dropping the sheets to the sheet receiving section, which can cause the ejected sheets to move toward the end-portion restriction plate in reaction to the collision of the rear end of the sheets against the collision plate. Also, it is possible to provide a driving means for biasing the collision plate toward the end-portion restriction plate after a sheet is dropped.

DETAILED DESCRIPTION OF THE PREFERRED EMBODIMENTS

Figure 1A:
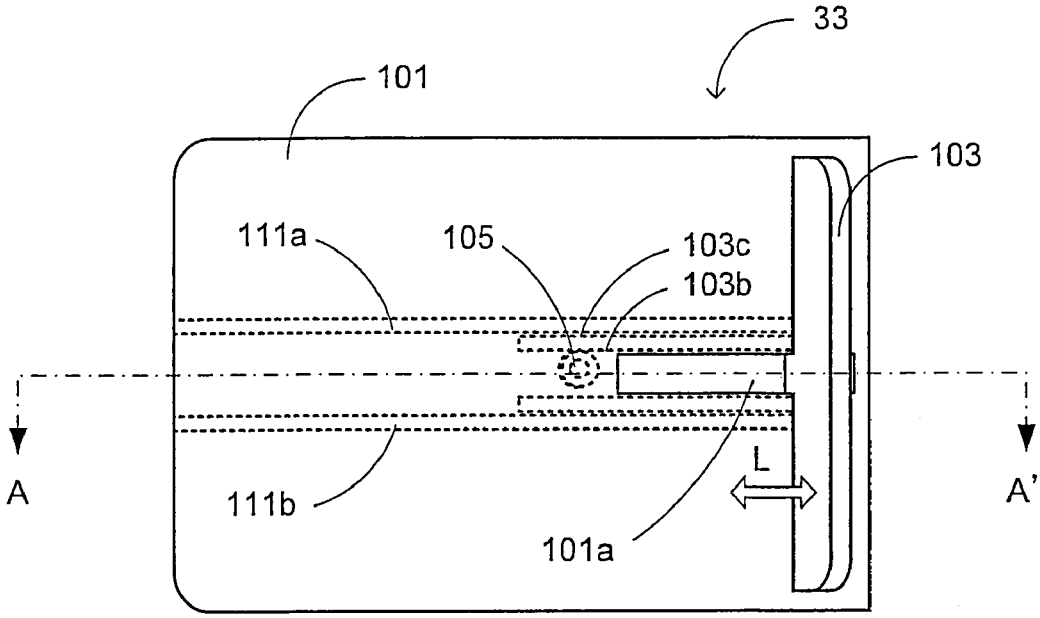
FIGS. 1A and 1B are structural views illustrating an exemplary exit tray as a sheet stacking device according to the present invention.

The sheet exit section may successively ejects plural sheets, and the restriction-plate driving section may set the position of the end-portion restriction plate such that a previously ejected sheet comes into contact at the rear end with the end-portion restriction plate, before a subsequently ejected sheet is received. This can prevent an ejected sheet from dropping onto a previously emitted sheet when the end portion of the previously ejected sheet closer to the sheet exit section is moving to the position of the end-portion restriction plate, thus obstructing the movement of the previous sheet. This can realize a preferable stackability.

The end-portion restriction plate may be changed in position in the sheet ejecting direction.

The sheet receiving section may be placed such that a side closer to the sheet exit section is lower for moving the received sheets in the direction opposite to the ejecting direction.

Also, the restriction-plate driving section may set the position of the end-portion restriction plate such that sheets with a larger size are spaced apart by a greater distance from the sheet exit section. A sheet having a larger size drops to a position on the sheet receiving section farther from the exit section. Consequently, the end-portion restriction plate can be moved to positions spaced apart by substantially a certain distance from the drop positions of sheets having respective sizes, which can make the time periods taken by the respective end portions of dropped sheets closer to the sheet exit section to reach the end-portion restriction plate substantially constant. This can realize a preferable stackability, even when the sheet ejecting interval is invariable regardless of sheet sizes.

The restriction-plate driving section may set the position of the end-portion restriction plate according to a weight per unit area of the sheets.

Also, the restriction-plate driving section may set the position of the end-portion restriction plate such that sheets with a smaller weight per unit area among sheets with a same size are spaced apart by a greater distance from the sheet exit section. Among sheets having the same size, sheets having a smaller weight per unit area (basis weight) drop to the sheet receiving section at a position farther from the exit section. Accordingly, the end-portion restriction plate can be moved to positions spaced apart by substantially a constant distance from the drop positions of respective sheets having different basis weights, which can make the time periods taken by the end portions of the dropped sheets to come into contact with the end-portion restriction plate substantially constant. This can realize a preferable stackability, even when the sheet ejecting interval is invariable regardless of sheet basis weights.

The sheet exit section ejects sheets at an ejecting speed according to the sheet type, and the restriction-plate driving section sets the position of the end-portion restriction plate according to the sheet ejecting speed.

The restriction-plate driving section may set the position of the end-portion restriction plate such that sheets ejected at a greater ejecting speed among sheets with a same size are spaced apart by a greater distance from the sheet exit section. In cases where sheets have the same size, as the sheet ejecting speed is increased, the sheets drop to a position on the sheet receiving section farther from the exit section. Accordingly, in cases where the ejecting speed is varied depending on the sheet type, the end-portion restriction plate can be moved to positions spaced apart by substantially a constant distance from the drop positions of respective sheets of different types, which can make the time periods taken by the end portions of the dropped sheets to come into contact with the end-portion restriction plate substantially constant. This can realize a preferable stackability, even when the sheet ejecting interval is invariable regardless of the types of sheets.

Also, the restriction-plate driving section may set the position of the end-portion restriction plate for every printing job to be executed by the image forming apparatus. This enables moving the end-portion restriction plate to a position corresponding to the printing size of each printing job. This can realize a preferable stackability.

Also, the sheet stacking device may further including; a driving motor for moving the end-portion restriction plate, and a driving mechanism including a rack and a pinion which are placed within or below the sheet receiving section, for transmitting a driving force of the driving motor to the end-portion restriction plate.

Also, the sheet stacking device may further comprising; a driving motor for driving the end-portion restriction plate, and an eccentric cam which is driven by the driving motor to turn, wherein the end-portion restriction plate is changed in position according to the turn of the eccentric cam.

Hereinafter, the present invention will be described in more detail, with reference to the drawings. The present invention can be better understood with the following description. However, the following description should be considered as illustrative, not restrictive, in all respects.

Structure of Image Forming Apparatus

Figure 3:
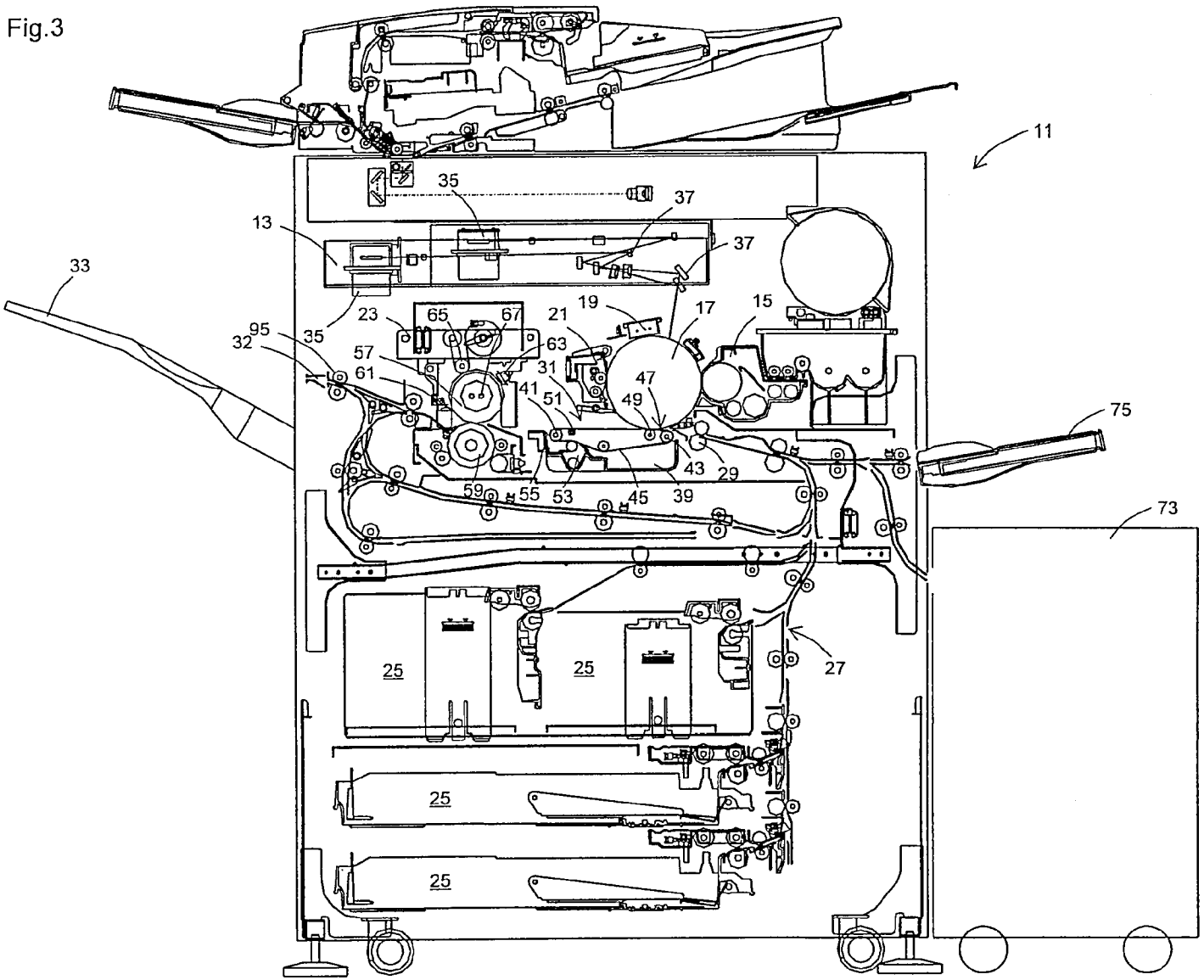
FIG. 3 is an explanation view illustrating an exemplary structure of an image forming apparatus 11 according to the present embodiment.

FIG. 3 is an explanation view illustrating an exemplary structure of an image forming apparatus 11 according to the present embodiment.

An image forming apparatus 11 prints images on predetermined sheets, according to image data received from the outside. As illustrated in FIG. 3, the image forming apparatus 11 includes an exposure unit 13, a developing unit 15, a photoconductor drum 17, a charging device 19, a cleaner unit 21, a fusing unit 23, and a sheet feeding tray 25. Further, the image forming apparatus 11 includes a sheet feeding path 27 extending upwardly from the sheet feeding tray 25, a resist roller 29, a transfer belt 45 and an exit roller 95. Further, the image forming apparatus 11 includes a sheet transporting path 31 extending from the end of the sheet feeding path 27 to the exit roller 95, a sheet exit section 32 and an exit tray 33 and the like.

The charging device 19 uniformly charges the surface of the photoconductor drum 17 to a predetermined electric potential. Although a charger-type charging device 19 is employed in FIG. 3, it is also possible to employ a contact roller type or brush type charging device 19.

The exposure unit 13 is a laser scanning unit (LSU) including a laser emitting section 35 and a reflection mirror 37. More specifically, the LSU in the present apparatus uses a two-beam technique which employs plural laser light sources for high-speed printing processing.

The exposure unit 13 applies light to the surface of the photoconductor drum 17 which has been uniformly charged by the charging device 19, the light being modulated according to input image data. Consequently, an electrostatic latent image corresponding to the image data is formed on the surface of the photoconductor drum 17.

The developing unit 15 visualizes the electrostatic latent image formed on the surface of the photoconductor drum 17 with charged toner. The cleaner unit 21 removes and collects residual toner on the surface of the photoconductor drum 17 which has been subjected to the development and the image transferring.

The toner on the photoconductor drum 17, which has been subjected to the visualization of the latent image as described above, is transferred to a sheet being transported along the sheet transporting path 31. A transfer mechanism 39 (a transfer belt unit in the present application) is a mechanism which applies, to a contact section 47, a transferring voltage having the polarity opposite to that of the electric charge on the toner for transferring the toner to the sheet. For example, in cases where the toner carries an electric charge with the negative polarity, a voltage with the positive polarity should to be applied to the transfer mechanism 39.

The transfer mechanism 39 in the present apparatus includes a transfer belt 45 which is stringed around a driving roller 41, a driven roller 43 and other rollers and has a predetermined resistance value (in the range of $1*10^9$ to $1*10^{13}$ ohm cm). At the contact section 47 between the aforementioned photoconductor drum 17 and the transfer belt 45, there is placed an elastic conductive roller 49 capable of applying the aforementioned transferring voltage. The elastic conductive roller 49 has elasticity. This brings the photoconductor drum 17 and the transfer belt 45 into surface contact with each other over a predetermined width (referred to as a transfer nip), not into line contact. This can improve the efficiency of transferring to the transported sheet.

Further, downstream of the transfer region along the transfer belt 45, a discharge roller 51 is placed. The discharge roller 51 discharges the sheet which has been charged by the voltage applied thereto when it passed through the contact section 47, for enabling smooth transportation thereof to the subsequent processing. The discharge roller 51 is placed on the back surface of the transfer belt 45.

Further, in the transfer mechanism 39, there are placed a cleaning unit 53 for eliminating toner contaminations on the transfer belt 45 and a discharging mechanism 55 for discharging the transfer belt 45. The aforementioned discharging mechanism 55 is grounded through the apparatus or a voltage with the polarity opposite to the polarity of the aforementioned transferring voltage is actively applied to the discharging mechanism 55.

The toner transferred to the sheet by the transfer mechanism 39 is transported to the fusing unit 23.

The fusing unit 23 includes a heat roller 57 and a pressure roller 59, wherein there are placed a sheet separation claw 61, a roller-surface temperature detection member (thermistor) 63 and a roller-surface cleaning member 65, around the outer peripheral portion of the heat roller 57. Further, inside of the heat roller 57, there is placed a heat source 67 for heating the surface of the roller to a predetermined temperature (a fusing set temperature: about 160 to 200 degree. C.).

On the other hand, at opposite end portions of the pressure roller 59, there are placed pressurizing members for pressing the pressure roller 59 against the aforementioned heat roller 57 with a predetermined pressure. Further, around the outer periphery of the pressure roller 59, similarly to the outer periphery of the heat roller 57, there are placed a sheet separation claw and a roller surface cleaning member.

The toner transferred to the sheet by the transfer mechanism 39 is heated by the temperature of the surface of the heat roller 57 at the pressurization section (referred to as a fusing nip section) between the aforementioned heat roller 57 and the pressure roller 59 to be fused and, after passing through the pressurization section, it is solidified. Further, in passing through the pressurization section, the toner experiences a pressing force from the pressure roller 59 to be fixed on the sheet.

The sheet feeding trays 25 are trays for stacking sheets to be used for image formation. In the present apparatus, four sheet feeding trays are provided below the image forming section. The present apparatus is intended for high-speed printing processing and, therefore, has a shorter sheet feeding interval. Accordingly, the sheet feeing trays 25 placed under the image forming section have large capacities capable of storing 500 to 1500 sheets with standard sizes. On the other hand, on a side surface of the apparatus, there is placed a large capacity sheet feeding cassette 73 capable of storing a greater number of sheets than those of the sheet feeding trays 25. Further, on the side surface of the apparatus, there is placed a manual sheet feeding tray 75 for use mainly in printing on sheets with non-standard sizes.

The exit tray 33 as a sheet stacking device is placed on the side surface opposite to the manual sheet feeding tray 75. Also, instead of the exit tray having a single function, it is possible to incorporate a sheet stacking device according to the present invention in a device for applying post-processing (stapling, punching and the like) to ejected sheets.

Further, the image forming apparatus 11 includes a main-part control section which is not illustrated. The main-part control section controls the operation of the image forming apparatus 11. The main-part control section is configured to include a microcomputer, a ROM which stores control programs defining processing procedures to be executed by the aforementioned microcomputer, and a RAM which offers work areas for operations. Further, the main-part control section is configured to include a nonvolatile memory for backing up and holding data required for control, an input circuit including an input buffer and an A/D conversion circuit connected to input signals from sensors and switches, and an output circuit including drivers for driving loads such as a motor, solenoids and lamps.

Embodiment 1

Figure 1B:
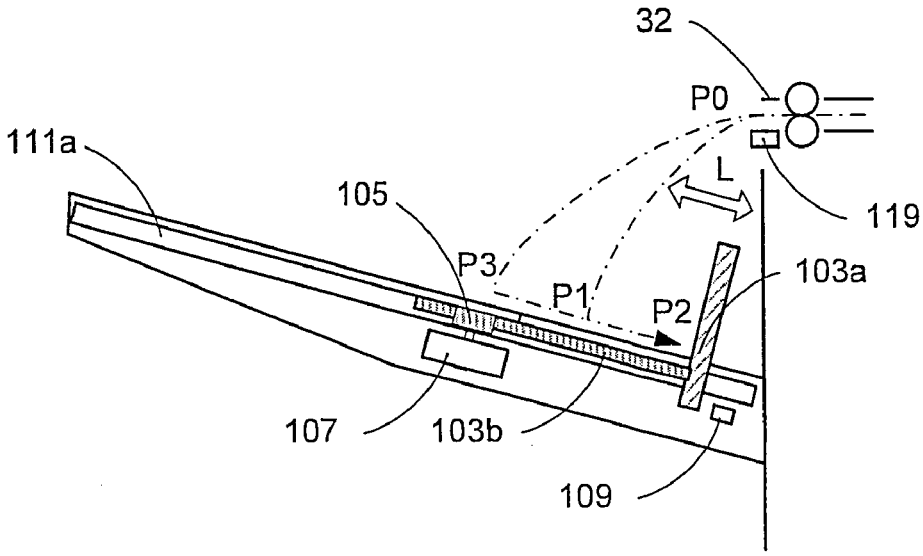

FIGS. 1A and 1B are structural views illustrating an exemplary exit tray as a sheet stacking device according to the present invention. FIG. 1A is a plan view and FIG. 1B is a cross-sectional view taken along a cross-sectional area A-A' in FIG. 1A.

As illustrated in FIGS. 1A and 1B, the exit tray 33 includes a tray plate 101 for receiving sheets ejected from the sheet exit section 32, an end-portion restriction plate 103 slidable in the direction of an arrow L, a driving motor 107 which slides the end-portion restriction plate 103, and a home position sensor 109 which detects the end-portion restriction plate 103 being at a home position. A part of the end-portion restriction plate 103 is vertically exposed above the tray plate 101, and the exposed portion is designated by character 103*a*. Further, the sheet exit section 32 is provided with an exit sensor 119 which detects the timing of passage of sheets being ejected therefrom.

The tray plate 101 corresponds to a sheet receiving section described in the claims. The sheet receiving section is placed to be inclined in the sheet ejecting direction. The inclination is such that the side of the sheet receiving section closer to the sheet exit section 32 is lower and its side farther from the sheet exit section 32 is higher. A sheet dropped from the sheet exit section 32 moves, due to its weight, on the tray plate 101 in such a direction that it returns toward the sheet exit section 32. Then, the sheet comes into contact, at its edge in the direction of movement, with the end-portion restriction plate 103 to be stopped. Plural sheets ejected to the exit tray 33 are stacked on the tray plate 101, with the end-portion restriction section 103*a* used as a reference. The tray plate 101 causes the respective sheets to move toward the sheet exit section 32, with its inclination.

Figure 2:
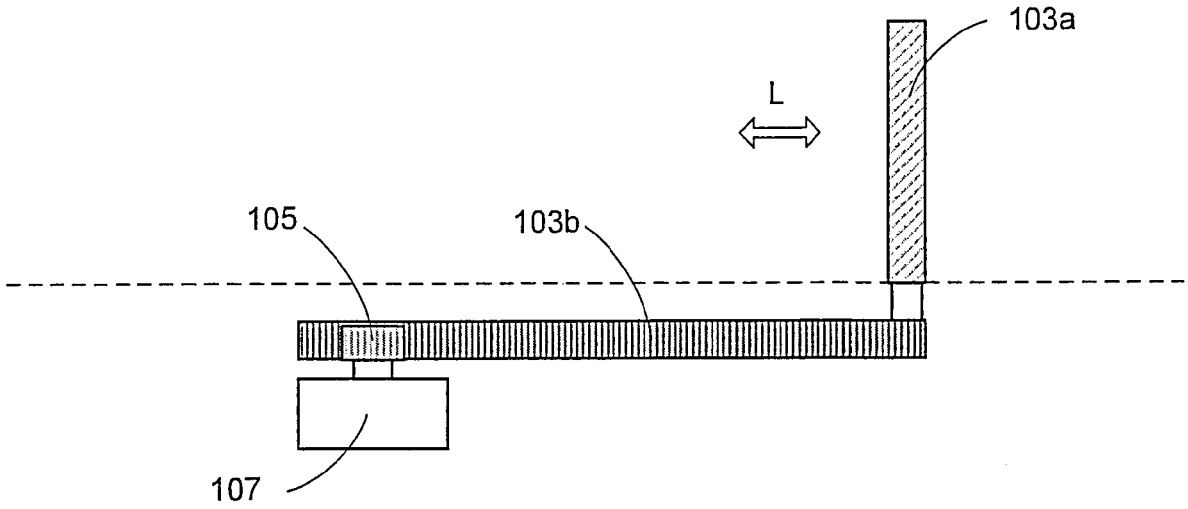
FIG. 2 is an explanation view illustrating details of an end-portion restriction plate 103 in FIG. 1B.

FIG. 2 is an explanation view illustrating details of the end-portion restriction plate 103 in FIG. 1B. The end-portion restriction plate 103 has an L shape in the sheet ejecting direction. The end-portion restriction plate 103 is partially within the tray plate 101, but the other portion is exposed above the tray plate 101. FIG. 2 illustrates the A-A' cross-sectional area in FIG. 1A. The right-hand portion which is designated by diagonal lines and character 103*a* is the end-portion restriction section 103*a* exposed above the tray plate 101. The end-portion restriction section 103*a* restricts the positions of sheets stacked on the tray plate 101. The bottom portion designated by character 103*b* is a rack gear which exists within the tray plate 101 and has teeth impressed on its surface.

The rack gear 103*b* engages with a pinion 105 fitted to the shaft of the driving motor 107 and slides in the direction of an arrow L along with the rotation of the driving motor 107. The driving motor 107 can be, for example, a step motor. The driving motor 107 is controlled in terms of driving thereof by a restriction-plate driving section which is not illustrated. The aforementioned restriction-plate driving section can be realized by a dedicated microcomputer and a dedicated driving circuit provided within the exit tray, but the main-part control section in the image forming apparatus in FIG. 3 can function as the restriction-plate driving section. In a case of providing such a restriction-plate driving section separate from the main-part control section, the restriction-plate driving section can perform control by communicating with the main-part control section.

Further, as illustrated in FIG. 1A, within the tray plate 101, there are provided guide rails 111*a* and 111*b* along the direction of sliding of the rack gear 103*b* to guide the end-portion restriction plate 103. A guide designated by a character 103*c* is the portion opposite to the surface of the rack gear 103*b* having the teeth impressed therein. The guide 103*c* is assembled integrally with the end-portion restriction section 103*a* and is guided in such a way that it is kept in contact with the guide rail 111*b*.

The tray plate 101 is provided with a slit section 101*a*. The portion of the end-portion restriction plate 103 which connects the end-portion restriction section 103*a* and the rack gear 103*b* to each other is moved in the slit section 101*a*.

There are illustrated, in FIG. 1B, the locus of the rear ends of sheets ejected from the sheet exit section 32, with dashed lines. In an example, the rear end of a sheet passes through a point P0 at which it comes away from the sheet exit section 32 and then drops in a parabola to reach a drop position P1 on the tray plate 101. The rear end of the sheet traveling in the ejecting direction dropped onto the tray plate 101 moves along the inclination of the tray plate 101 due to the weight of the sheet and reaches a point P2 at which it comes into contact with the end-portion restriction section 103*a*. Namely, a front end of the sheets moving in the direction opposite to the ejecting direction comes into contact with the end-portion restriction plate 103.

Further, the rear end of a sheet having a size different from that of the aforementioned sheet drops to a point P3 which is farther from the sheet exit section 32 than the point P1. Thereafter, the rear end of the sheet dropped to the point P3 moves along the inclined surface of the tray plate 101 and reaches the point P2 (the end-portion restriction position), due to the weight of the sheet. It has been empirically proven that the position to which a sheet drops depends on the size of the sheet, and a sheet having a smaller size (a smaller-sized sheet) drops to a position farther from the sheet exit section 32 than that of a sheet having a larger size (a larger-sized sheet). Further, among sheets having the sheets, a sheet having a greater weight per unit area (basis weight) drops to a position farther from the sheet exit section 32. Further, as the sheet ejecting speed is increased, sheets drop to positions farther from the sheet exit section 32. As described above, the positions to which sheets drop are varied depending on the sheets. However, the speed at which dropped sheets move on the tray plate 101 is not significantly varied. Accordingly, assuming that the position of the end-portion restriction plate 103 is fixed, a sheet dropped to a position farther from the sheet exit section 32 takes a longer time to reach the point P2.

On the other hand, if, when a dropped sheet is moving on the tray plate 101 along the inclination thereof, a subsequent sheet drops, then the subsequent sheet exerts its weight on the moving sheet, which increases the frictional force therebetween. This obstructs the movement of the sheets, thereby degrading the ability to stack the sheets. The sheet ejecting interval depends on the printing speed of the image forming apparatus and, therefore, it is impossible to easily increase the sheet ejecting interval because of degradation of the stackability. Therefore, in the present embodiment, the end-portion restriction plate 103 is made slidable depending on the types of sheets to enable changing the position of the point P2. This can optimize the time periods taken by sheets to move from their drop positions to the end-portion restriction position, thereby allowing a previous sheet to move to the end-portion restriction position before the subsequent sheet drops.

Prediction of Drop Position

According to the present invention, the end-portion restriction plate 103 of the exit tray 33 can be moved, according to drop positions predicted according to sheets (predicted drop positions). In this case, for example, drop positions can be determined through experiments for various types of sheets prior to the shipment of the apparatus from the factory and, based on the results of determinations, predicted drop positions of sheets can be determined. Such various types of sheets are, for example, sheets having various sizes and basis weights and made of various materials.

Figure 7:
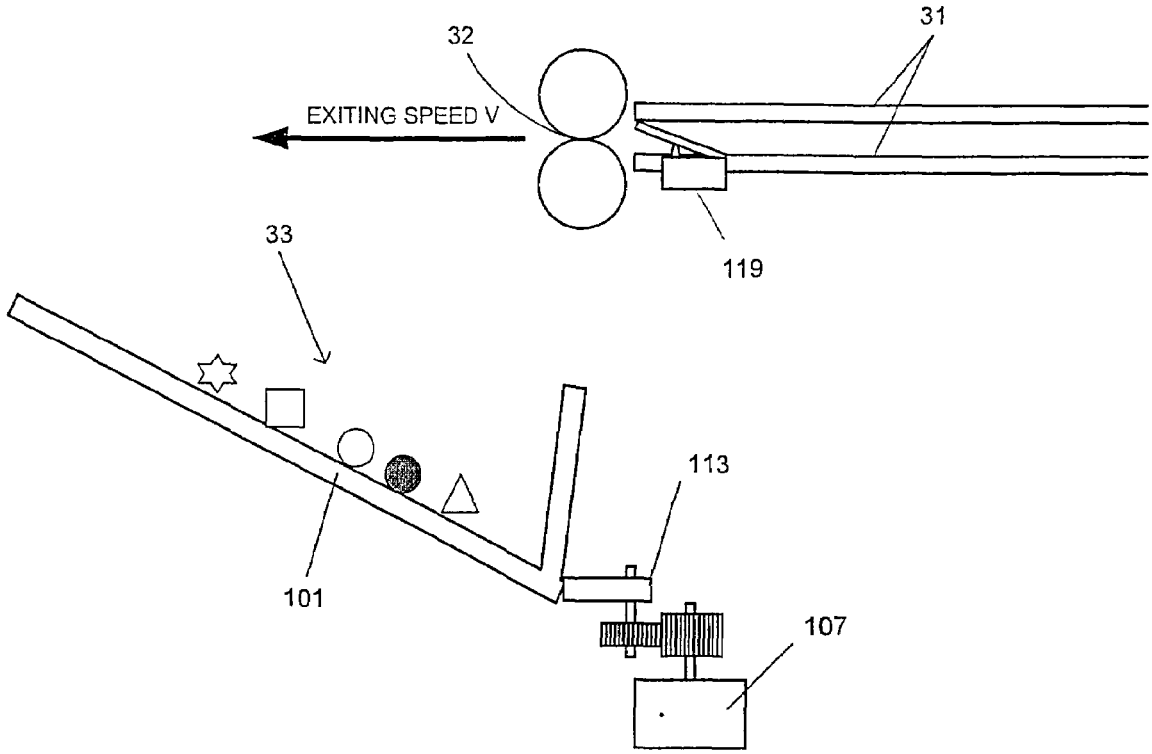
FIG. 7 is an explanation view illustrating the tendency of drop positions of sheets, on the exit tray according to the present invention.

FIG. 7 is an explanation view qualitatively illustrating the results of determinations of sheet drop positions, using the exit tray according to the present invention. FIG. 7 is based on experiments. In FIG. 7, there are illustrated marks at the positions on the tray plate 101 of the exit tray 33 to which the rear ends of plural sheets having different sizes and basis weights drop, in a case where the sheets are ejected from the sheet exit section 32 at a predetermined ejecting speed V. In this case, the position of the exit tray 33 is fixed.

The marks of the drop positions indicate the relative relationship among these drop positions in terms of the distance from the sheet exit section 32. Among sheets having a basis weight of 85 g/m$^2$, an A3-size sheet (a triangular mark) drops to a position closest to the sheet exit section 32, a smaller A4-size sheet (a circular mark) drops to a position farther from the sheet exit section 32 than that of the A3-size sheet and a smallest A5-size sheet (a square mark) drops to a position farthest from the sheet exit section 32.

Among sheets having the same size and different basis weights, an A4-size sheet having a basis weight of 100 g/m$^2$ (a black circular mark) drops to a position closer to the sheet exit section 32 than that of the sheet having a basis weight of 85 g/m$^2$. Further, a post card having an A6 sheet size and a basis weight of 128 g/m$^2$ drops to a position farthest from the sheet exit section 32. As described above, the drop position of a sheet depends on the size and the basis weight of the sheet. Further, as a matter of cause, the drop position of a sheet depends on the ejecting speed. Accordingly, for example, in cases of apparatuses having an ejecting speed in an OHP-sheet mode smaller than that for normal sheets, a drop position should be predicted according to the ejecting speed in the OHP-sheet mode.

As described above, sheet drop positions can be determined in advance according to the type of the apparatus, then, based on the results of determinations, typical positions, namely predicted drop positions, can be determined, and the determined positions can be stored. With respect to the predicted drop positions, the positions to which the end-portion restriction plate 103 should be moved, namely the end-portion restriction positions, can be determined. For example, the end-portion restriction positions are set to positions spaced apart from the predicted drop positions by a certain distance toward the sheet exit section 32. However, the sheet ejecting interval may be varied depending on the size of sheets, in many cases. Accordingly, the end-portion restriction positions can be determined, in consideration of the ejecting interval difference among sheet sizes.

The restriction-plate driving section controls the end-portion restriction plate 103 in such a way that it moves to an end-portion restriction position, according to the size of sheets ejected from the sheet exit section 32 and the sheet type, such as the basis weight and the material thereof. The main-part control section has information about the size of sheets ejected from the sheet exit sections 32 and the sheet type, such as the material thereof. For example, in the image forming apparatus 11 of FIG. 3, the main-part control section grasps the sizes of sheets set in the sheet feeding trays 25, the large capacity sheet feeding cassette 73 or the manual sheet feeding tray 75 and the types of these sheets, such as the materials (normal sheets, thick sheets or OHP sheets) thereof. From the types of sheets, the basis weights and the ejecting speeds of the sheets can be grasped.

In a case where the main-part control section also serves as the restriction-plate driving section, the main-part control section controls the driving of the end-portion restriction plate 103, such that the end-portion restriction plate 103 is moved to an end-portion restriction position corresponding to the grasped sheet type such as the size, the basis weight and the material thereof. In a case where the restriction-plate driving section is separate from the main-part control section, the restriction-plate driving section can be configured to acquire the sizes and types of sheets by communicating with the main-part control section.

Control on End-Portion Restriction Plate

Figure 8:
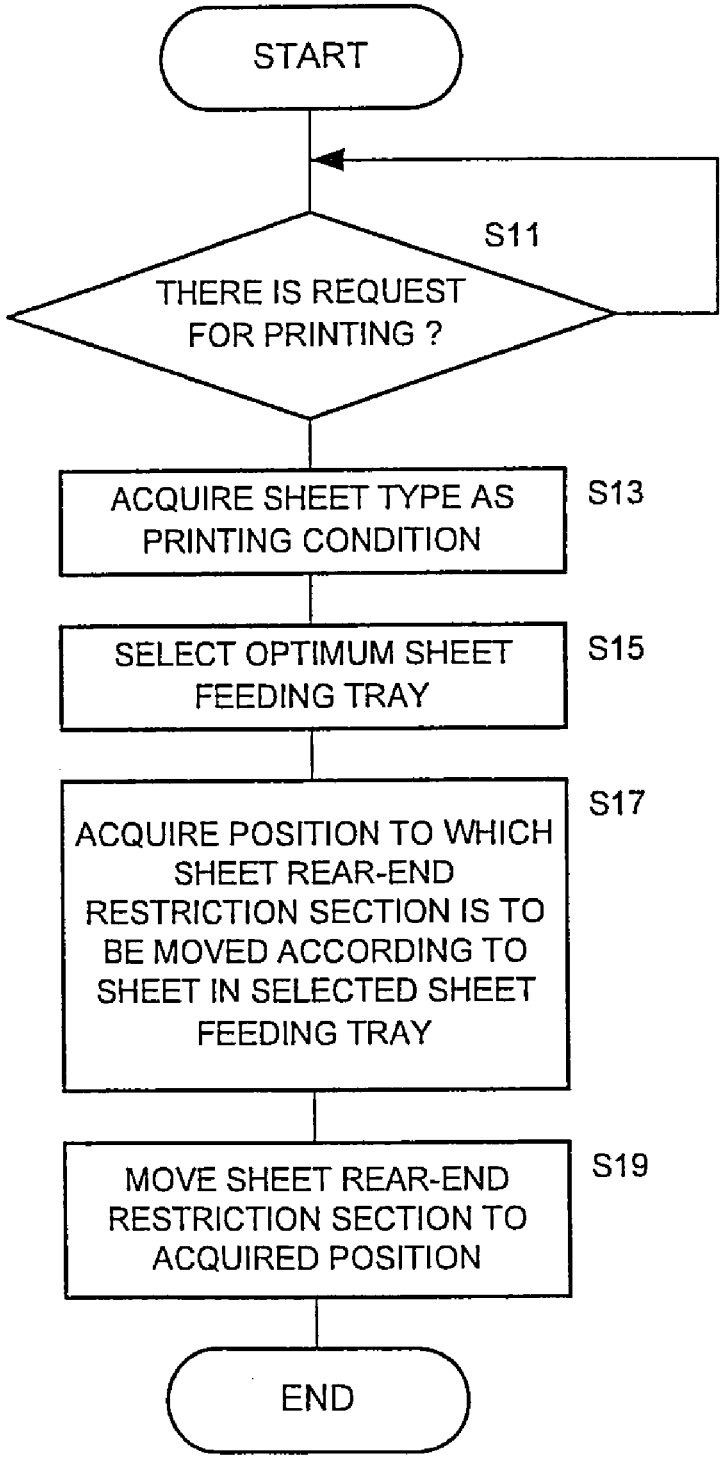
FIG. 8 is a flow chart illustrating a procedure for causing a restriction-plate driving section according to the present invention to control the position of the end-portion restriction plate.

Hereinafter, there will be described an exemplary procedure for causing the restriction-plate driving section to control the position of the end-portion restriction plate 103. FIG. 8 is a flow chart illustrating an exemplary procedure for causing the restriction-plate driving section according to the present invention to control the position of the end-portion restriction plate. The following description will be given on the assumption that the main-part control section also serves as the restriction-plate driving section.

On receiving a printing request from the outside (step S11), the main-part control section starts printing processing in response to the request. Such a printing request is supplied from a host connected to the image forming apparatus 11 through a network, for example. Also, in a case of copying, a user supplies such a printing request by operating an operating section of the image forming apparatus 11. A printing condition is also supplied along with the printing request, and the condition includes a specification of a sheet size or a sheet feeding tray (step S13).

More specifically, the sheet size defined by the printing request is a requested size, but the main-part control section determines the sheet size to be finally used for printing by selecting an optimum sheet feeding tray in response to the request. The main-part control section grasps the types of the sheets set in the respective sheet feeding trays, such as the sizes of the sheets. For example, the manual sheet feeding tray 75 has a sheet-size detection mechanism, and the main-part control section acquires the sheet size detected by the detection mechanism. Further, the sheet type such as the basis weight and the material thereof (normal sheets, thick sheets or OHP sheets), other than the size, are input by the user through the operating section of the image forming apparatus 11, when he or she sets the sheets on the manual sheet feeding tray 75. The main-part control section acquires the input sheet type. The main-part control section also acquires the types of sheets in the sheet feeding trays 25 and the large capacity sheet feeding cassette 73, similarly. However, the types of sheets in the trays other than the manual sheet feeding tray are fixed and, therefore, the sheet sizes of the trays other than the manual sheet feeding tray can be set by inputting through the operating section.

Also, as well as the types of sheets, the end-portion restriction positions to which the end-portion restriction plate 103 should be moved can be set through the operating section, in association with the respective sheet feeding trays. This enables setting the end-portion restriction position according to set sheets through the operating section, even when sheets with a user-settable size (a so-called non-standard size) are set in any of the sheet feeding trays. Such setting can be made by either a service engineer or a user.

As described above, the main-part control section grasps the types of sheets corresponding to the respective sheet feeding trays. Then, the main-part control section selects a sheet feeding tray in response to the printing request (step S15). If sheets set in any of the sheet feeding trays correspond to the requested sheet type, the main-part control section selects the sheet feeding tray. If there are not set sheets corresponding to the request, it is possible to conduct some processes. For example, the main-part control section can select a sheet feeding tray in which sheets having a smallest size, out of sheets having sizes capable of printing the request size without dropping it out, are set.

The main-part control section moves the end-portion restriction plate 103 to an end-portion restriction position, according to the selected sheet feeding tray, prior to starting a printing job. End-portion restriction positions have been determined in advance in association with the types of sheets such as the sizes thereof and have been stored as numbers of steps from the home position in a data table in the ROM. The main-part control section refers to the aforementioned data table and acquires an end-portion restriction position, according to the sheet type set in the selected sheet feeding tray (step S17). Then, the main-part control section moves the end-portion restriction plate 103 to the acquired end-portion restriction position (step S19). At this time, the end-portion restriction plate 103 is moved to the home position at first. Then, when the home position sensor 109 detects the end-portion restriction plate 103, the driving motor 107 is stopped. Thereafter, the driving motor 107 is rotated in the counter direction, by the number of steps acquired from the aforementioned data table.

As described above, the main-part control section moves the end-portion restriction plate 103 to the end-portion restriction position corresponding to the sheet. The end-portion restriction plate 103 is moved prior to start of printing, for each printing job.

Embodiment 2

Figure 4B:
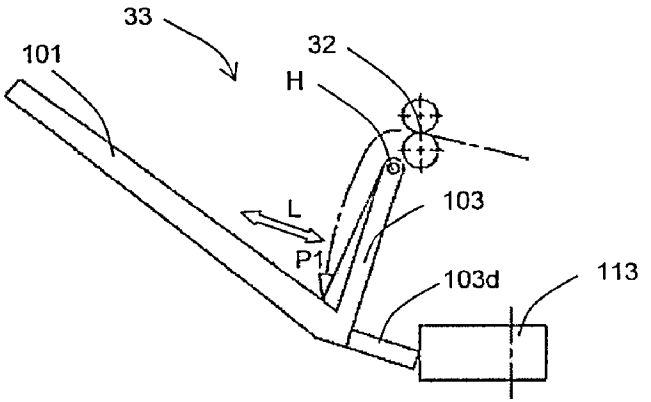
FIGS. 4A to 4D are structural views illustrating an exemplary exit tray different from that in FIGS. 1A and 1B.
Figure 4D:
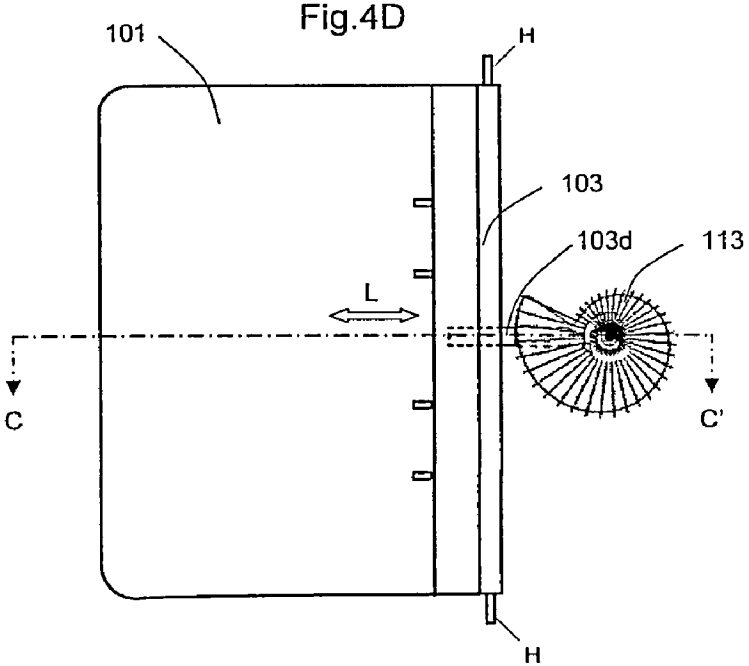
Figure 4A:
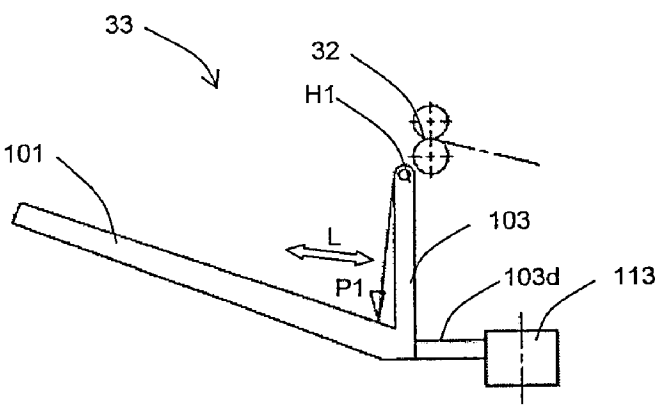
Figure 4C:
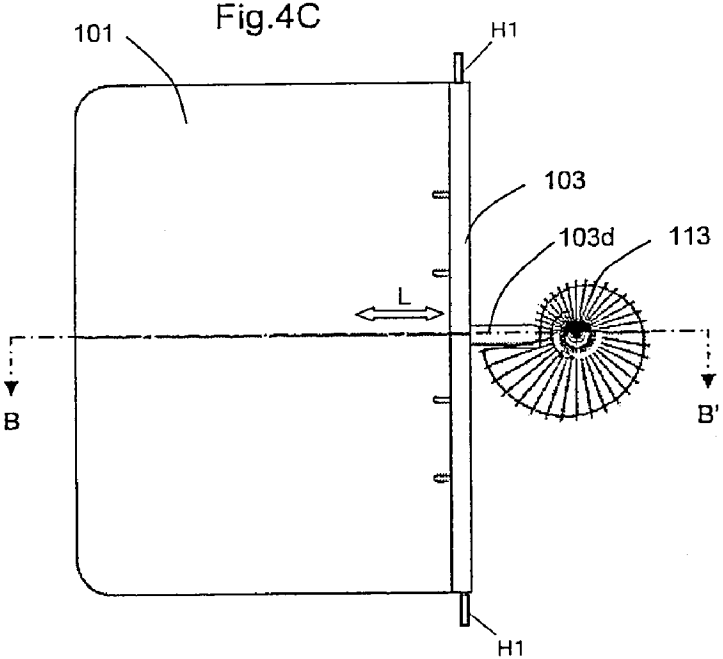

In the present embodiment, there will be described an exit tray according to an aspect different from the first embodiment. FIGS. 4A to 4D are structural views illustrating an exemplary exit tray different from that of FIGS. 1A and 1B. FIG. 4A illustrates a state where the exit tray 33 is positioned for larger sizes, and FIG. 4B illustrates a state where the exit tray 33 is positioned for smaller sizes. FIG. 4A and FIG. 4B are cross-sectional views taken along the direction of transfer of sheets. FIG. 4C is a plan view corresponding to FIG. 4A. FIG. 4D is a plan view corresponding to FIG. 4B. Namely, FIG. 4A is a cross-sectional view taken along B-B' in FIG. 4C. Further, FIG. 4B is a cross-sectional view taken along C-C' in FIG. 4D. The exit tray illustrated in FIGS. 4A to 4D is constituted by an inclined tray plate 101 and an end-portion restriction plate 103 integrated with each other and thus has an L-shaped cross-sectional area. Sheets dropped to the tray plate 101 move along the inclined surface of the tray plate 101 until their end portions come into contact with the end-portion restriction plate 103. Accordingly, the end-portion restriction plate 103 forms an end-portion restriction section for restricting the positions of sheets.

The exit tray 33 is supported rotatably with a shaft H1 extending in the depthwise direction in FIG. 4A and FIG. 4B served as a supporting point. If the exit tray 33 is rotated with H1 served as a supporting point, this causes the lower end portion of the end-portion restriction plate 103 to move in the direction of an arrow L. An arm 103*d* is protruded from the lower end portion of the end-portion restriction plate 103, and the end portion thereof is in contact with a cam surface of an eccentric cam 113 due to the weight of the exit tray 33. The eccentric cam 113 is rotatable about a vertical shaft and is driven by a driving motor which is not illustrated in FIGS. 4A to 4D. If the eccentric cam 113 is rotated to change the angle thereof, this causes the exit tray 33 to rotate with H1 served as a supporting point. This causes the lower end portion of the end-portion restriction plate 103 to move.

FIG. 4B and FIG. 4D illustrate a state where the eccentric cam 113 has been rotated from the position of FIG. 4A and FIG. 4C and has been moved away from the sheet exit section 32.

With the exit tray of FIGS. 4A to 4D, it is possible to realize movement of the end-portion restriction plate 103 with a simple structure. Further, at the position for smaller-size sheets which causes sheets to drop to positions farther from the sheet exit section 32, the tray plate 101 has a greater inclination. This can offer the advantage that smaller-size sheets can move from their drop positions to the end-portion restriction position at a greater speed than that of larger-size sheets. Usually, the sheet ejecting interval for smaller-size sheets is set to be smaller than that for larger-size sheets.

Figure 5C:
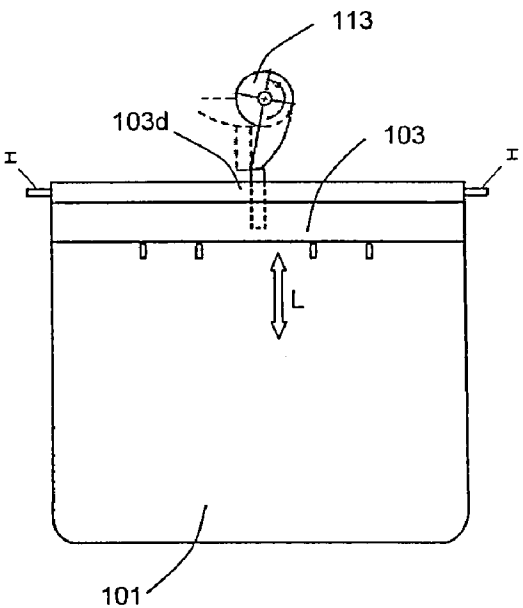
FIGS. 5A to 5C are explanation views of an exit tray including an eccentric cam 113 having a different from that of FIGS. 4A to 4D, according to the present invention.
Figure 5B:
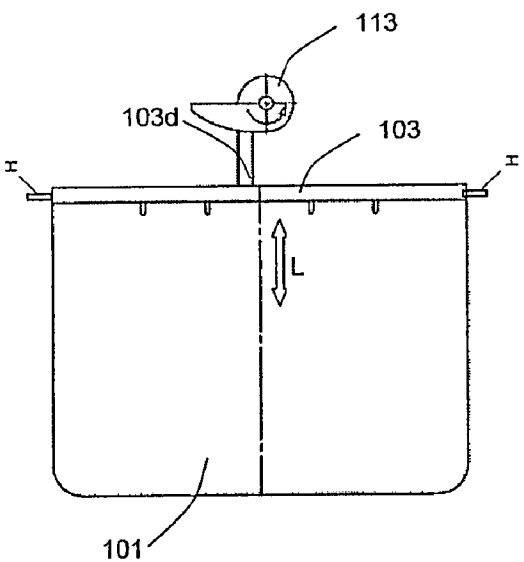
Figure 5A:
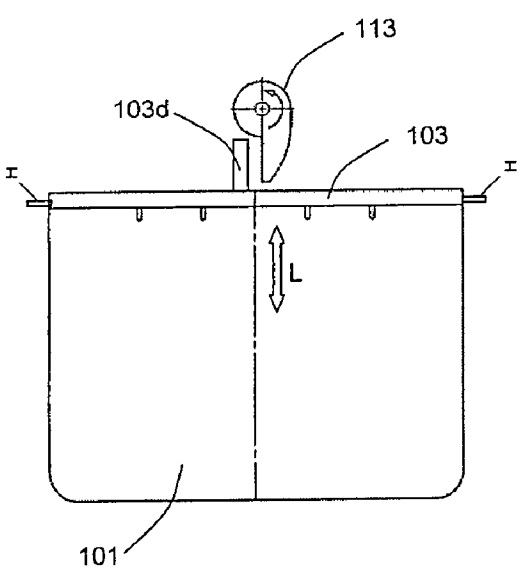

FIGS. 5A to 5C are explanation views of an exit tray having an eccentric cam 113 with a shape different from that of FIGS. 4A to 4D. In FIGS. 5A to 5C, when the eccentric cam 113 is at an angle of FIG. 5A or an angle of FIG. 5B, the exit tray is adapted to larger-size sheets and, when the eccentric cam 113 is at an angle of FIG. 5C, the exit tray is adapted to smaller-size sheets. The position of the exit tray 33 can be varied in the two steps for larger-size sheets and smaller-size sheets. In comparison with FIGS. 5A to 5C, the amount of movement of the end-portion restriction plate 103 with respect to the change of the angle of the eccentric cam 113 is greater, which can reduce the time period required for the movement. However, the driving motor is required to offer greater driving torques.

Figure 6B:
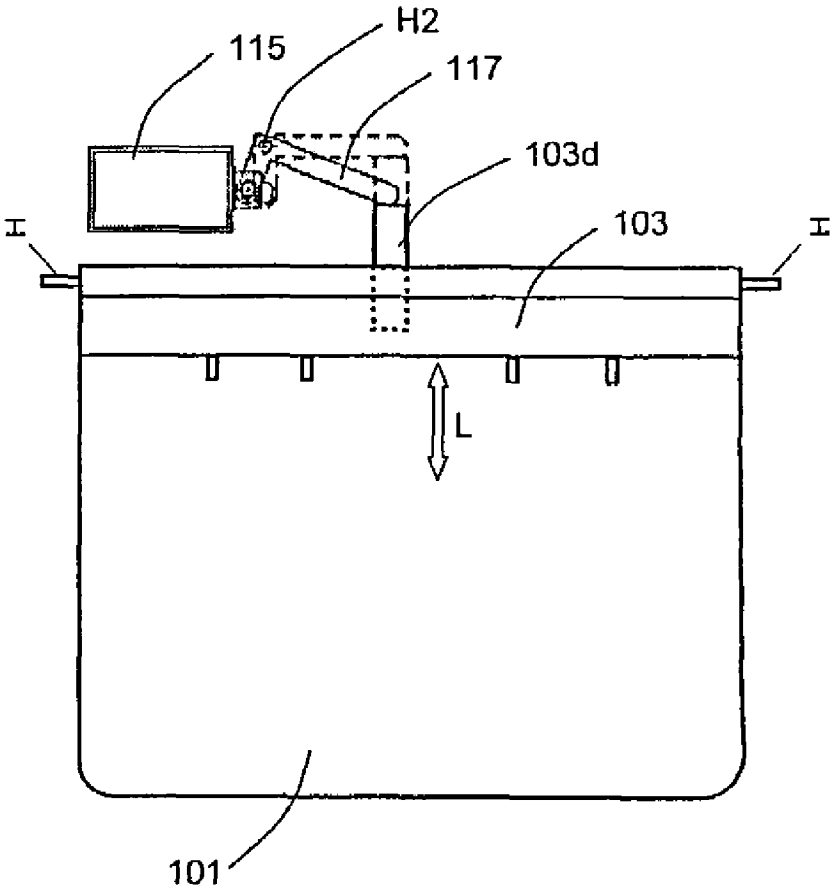
FIGS. 6A and 6B are explanation views illustrating an example of moving the exit tray according to the present invention, using a solenoid.
Figure 6A:
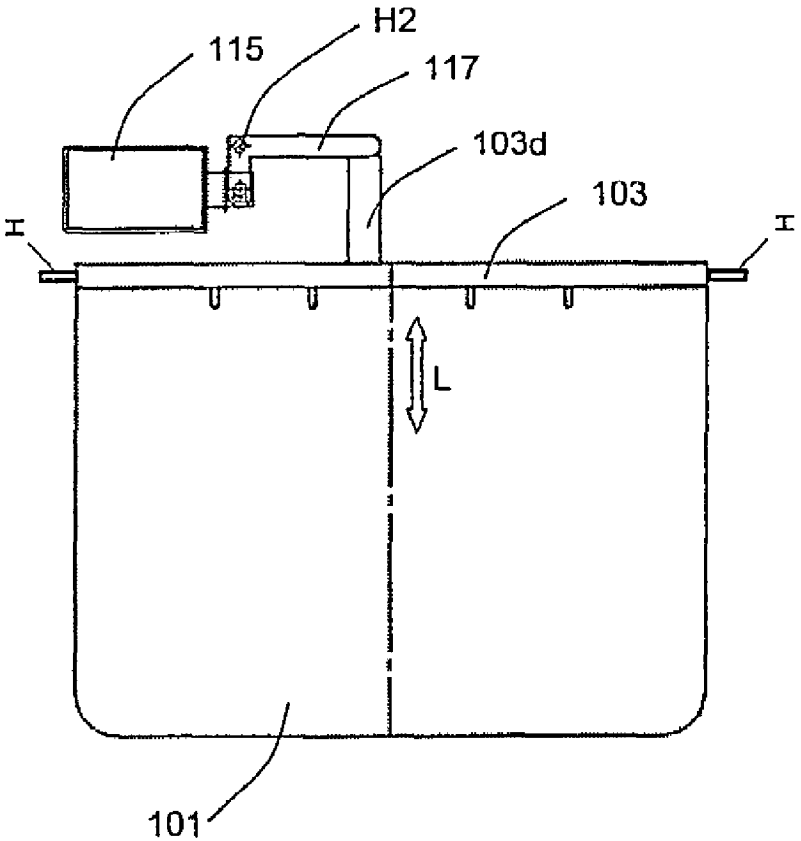

FIGS. 6A and 6B are explanation views illustrating an exemplary mechanism for moving the position of the exit tray 33 with a solenoid. In the mechanism of FIGS. 6A and 6B, a link member 117 is coupled at its one end portion to the plunger section of a driving solenoid 115. The link member 117 is rotated with a shaft H2 served as a supporting point, along with the movement of the aforementioned plunger section. The other end of the link member 117 is in contact with an arm 103*d* of the exit tray 33. When the driving solenoid 115 is at a non-conduction state, the exit tray 33 is at a position for larger sizes in FIG. 6A, due to its weight. When the driving solenoid 115 is conducting, the plunger section thereof is drawn into the inside of the solenoid, thereby causing the link member 117 to rotate with H2 served as the supporting point. This causes the exit tray 33 to move to a position for smaller sizes in FIG. 6B.

Embodiment 3

Figure 9A:
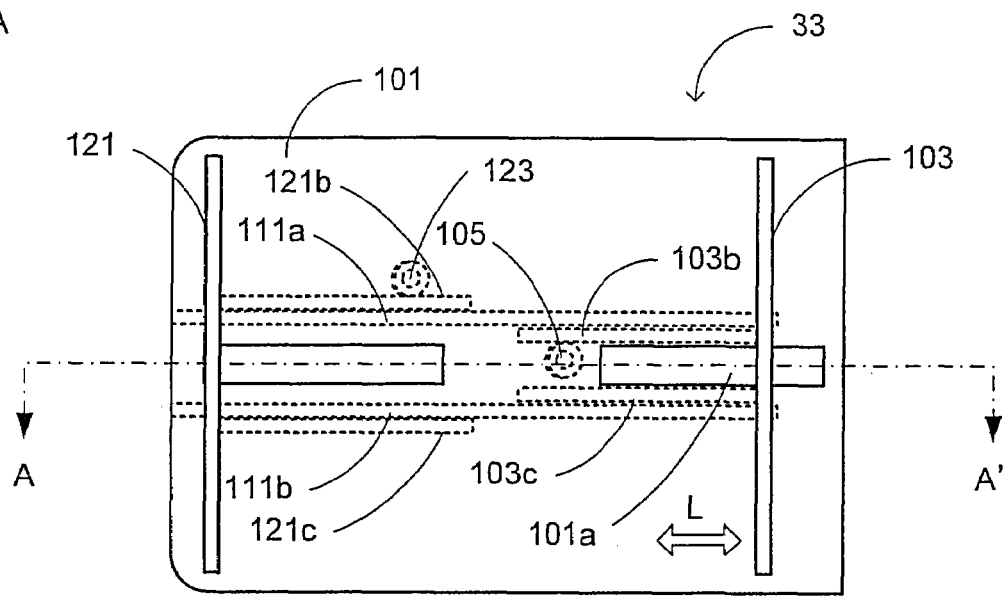
FIGS. 9A and 9B are structural views illustrating an exemplary exit tray different from that of FIGS. 1A and 1B.
Figure 9B:
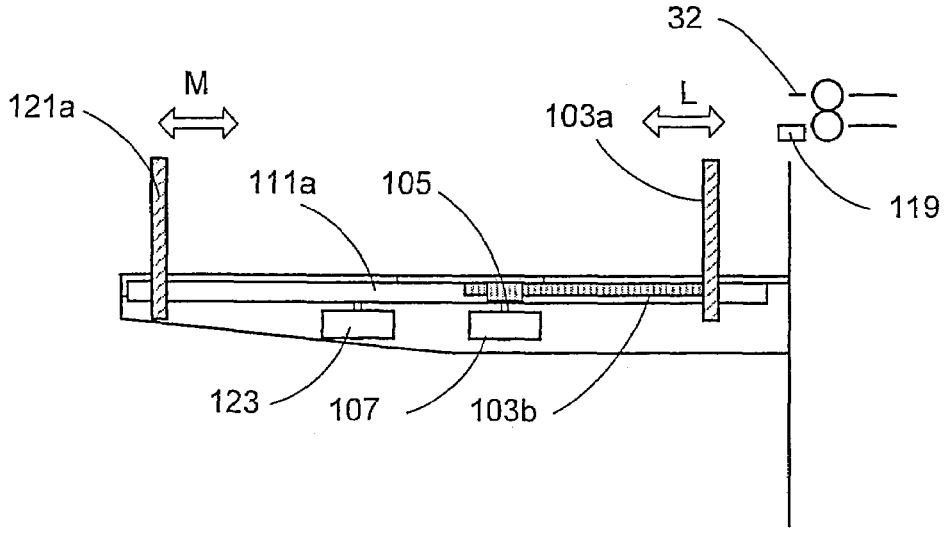

In the present embodiment, there will be described a method for moving sheets dropped to the tray plate 101 toward the sheet exit section 32, according to a different aspect. FIGS. 9A and 9B are structural views illustrating an exemplary exit tray different from that of FIGS. 1A and 1B. The tray plate 101 in FIGS. 9A and 9B is placed substantially horizontally. In this regard, the tray plate 101 is different from the inclined tray plate of FIGS. 1A and 1B. Further, the exit tray 33 of FIGS. 9A and 9B has a collision plate 121 on the tray plate 101. The collision plate 121 is driven by a collision-plate driving motor 123. If the collision-plate driving motor 123 is rotated, this causes a pinion mounted to the shaft thereof to rotate. A collision-plate guide rail section 121*b* has a rack gear impressed in its surface, wherein the rack gear engages with the pinion. If the collision-plate driving motor 123 is rotated, the collision-plate guide rail 121*b* is moved in the direction of an arrow M. This causes the collision plate 121 integrated with the collision-plate guide rail section 121*b* to slide in the direction of the arrow M.

The collision-plate driving motor 123 is driven by a collision-plate driving section which is not illustrated. The collision-plate driving section can be realized by the microcomputer and the driving circuit which constitute the restriction-plate driving section. Also, a part of the main-part control section can realize the functions of the collision-plate driving section.

The exit tray 33 in FIGS. 1A and 1B includes the inclined tray plate 101, which causes sheets to move to the end-portion restriction section 103, due to their weights. On the other hand, the exit tray 33 in FIGS. 9A and 9B includes the collision plate 121 which is slid in the direction of the arrow M to press sheets toward the end-portion restriction section 103, thereby moving the sheets to the end-portion restriction section 103.

The collision plate 121 has a sheet aligning section 121*a* which is vertically exposed above the tray plate 101. The sheet aligning section 121*a* stands by at such a position that a sheet being dropped onto the tray plate 101 collides at its edge against a side surface of the sheet aligning section halfway through the dropping. The sheet collided thereagainst drops downwardly. The standby position of the sheet aligning section 121*a* can be determined according to the sheet size. Also, it can be determined according to the basis weight of the sheet. At the timing when the sheet drops to the tray plate 101, the collision-plate driving section slides the sheet aligning section 121*a* toward the end-portion restriction plate. Then, the collision-plate driving section moves the sheet to the position at which one end of the sheet comes into contact with the end-portion restriction plate 103. Thereafter, the sheet aligning section 121*a* is restored to the original position, before a subsequent sheet is dropped.

Finally, it is apparent that various modifications can be made to the present invention, as well as the aforementioned embodiments. Such modifications are intended to be included within the spirit and scope of the invention. The scope of the invention is intended to cover equivalents of the subject matter of the claims and all modifications falling within the scope of the invention.

The invention claimed is:

1. A movable sheet stacking device comprising:

a sheet receiving section which is provided with respect to a sheet exit section of an image forming apparatus and is for receiving ejected sheets being ejected from the sheet exit section in an ejecting direction and moving the sheets in a direction opposite to the ejecting direction;

an end-portion restriction plate which comes into contact with a front end of the sheets moving in the opposite direction to stop the movement of the sheets; and a restriction-plate driving section which sets a position of the end-portion restriction plate according to a sheet type.

2. The sheet stacking device according to claim 1, wherein the sheet exit section successively ejects plural sheets, and the restriction-plate driving section sets the position of the end-portion restriction plate such that a previously ejected sheet comes into contact at the front end with the end-portion restriction plate, before a subsequently ejected sheet is received.

3. The sheet stacking device according to claim 1, wherein the end-portion restriction plate can be changed in position in the sheet ejecting direction.

4. The sheet stacking device according to claim 1, wherein the sheet receiving section is placed such that a side closer to the sheet exit section is lower for moving the received sheets in the direction opposite to the ejecting direction.

5. The sheet stacking device according to claim 3, wherein the restriction-plate driving section sets the position of the end-portion restriction plate such that sheets with a smaller size are spaced apart by a greater distance from the sheet exit section.

6. The sheet stacking device according to claim 1, wherein the restriction-plate driving section sets the position of the end-portion restriction plate according to a weight per unit area of the sheets.

7. The sheet stacking device according to claim 6, wherein the restriction-plate driving section sets the position of the end-portion restriction plate such that sheets with a smaller weight per unit area among sheets with a same size are spaced apart by a greater distance from the sheet exit section.

8. The sheet stacking device according to claim 1, wherein the sheet exit section ejects sheets at an ejecting speed according to the sheet type, and the restriction-plate driving section sets the position of the end-portion restriction plate according to the sheet ejecting speed.

9. The sheet stacking device according to claim 8, wherein the restriction-plate driving section sets the position of the end-portion restriction plate such that sheets ejected at a greater ejecting speed among sheets with a same size are spaced apart by a greater distance from the sheet exit section.

10. The sheet stacking device according to claim 1, wherein the restriction-plate driving section sets the position of the end-portion restriction plate for every printing job to be executed by the image forming apparatus.

11. The sheet stacking device according to claim 1, further comprising;

a driving motor for moving the end-portion restriction plate, and a driving mechanism including a rack and a pinion which are placed within or below the sheet receiving section, for transmitting a driving force of the driving motor to the end-portion restriction plate.

12. The sheet stacking device according to claim 1, further comprising;

a driving motor for driving the end-portion restriction plate, and an eccentric cam which is driven by the driving motor to turn, wherein the end-portion restriction plate is changed in position according to the turn of the eccentric cam.

13. An image forming apparatus comprising the sheet stacking device according to claim 1.

* * * * *